United States Patent [19]

Kelley

[11] 4,349,300

[45] Sep. 14, 1982

[54] SYSTEMIC ROOF SUPPORT

[76] Inventor: Jay H. Kelley, 104-1/2 Watson Ave., Fairmont, W. Va. 26554

[21] Appl. No.: 180,598

[22] Filed: Aug. 25, 1980

Related U.S. Application Data

[63] Continuation-in-part of Ser. No. 45,501, Jun. 4, 1979, abandoned.

[51] Int. Cl.[3] ..... E21D 11/00; E04C 5/12

[52] U.S. Cl. ..... 405/288; 405/259

[58] Field of Search ..... 405/288, 290, 259, 260, 405/261, 258; 291/11

[56] References Cited

U.S. PATENT DOCUMENTS

| | | | |
|---|---|---|---|
| 1,559,560 | 11/1925 | Doughty | 405/288 X |
| 3,216,306 | 11/1965 | Taylor | 405/259 X |
| 3,427,811 | 2/1969 | White | 405/259 |
| 3,509,726 | 5/1970 | White | 405/259 |
| 4,091,628 | 5/1978 | Kelley | 405/290 |

*Primary Examiner*—Dennis L. Taylor

*Attorney, Agent, or Firm*—Thomas H. Murray; Clifford A. Poff

[57] ABSTRACT

Support for native roof strata in a mine opening includes an elongated tensile member arranged horizontally and immediately below the lowest stratum layer of the native roof strata. The tensile member is anchored with bolt members under a prestressed elongation at a site within the upper stratum and horizontally remote to the roof strata to impose the prestressing reactive forces upon the upper stratum as a compressive stress. The emplaced tensile member distributes an upward force upon the roof strata to shear resistance by increasing friction between the layers of the strata. The bolt members extend over a pillar of native strata at an angle of between 0° and 30° to the horizontal, preferably about 5° to 15°. In one embodiment, a profiled spacer is used between the tensile member and the lowest stratum layer for creating the increased friction between the layers of native roof strata. When the tensile member takes the form of a tensile skin strip, then roof bolts are used to bind the tensile skin to the lower stratum layers for creating increased friction therebetween. When the tensile member has an arch-shaped configuration, it is arranged with the curved ends extending downwardly from the lowest roof stratum layer. The arch-shaped elastic member is prestressed by directing a force upon each of the curved ends to compressively stress the elastic member against the roof strata where it is anchored by the bolt members.

17 Claims, 9 Drawing Figures

SYSTEMIC ROOF SUPPORT

CROSS-REFERENCE TO RELATED APPLICATION

This application is a continuation-in-part of application Ser. No. 45,501, filed June 4, 1979, now abandoned.

BACKGROUND OF THE INVENTION

This invention relates to a method and apparatus for a systemic roof control of native roof strata in a mine opening wherein natural roof strata is utilized as a major structural component in the system to convert incompetent roof strata into an effective continuous beam which spans across a mine opening. More particularly, the present invention utilizes a prestressed tensile member connected at anchor sites horizontally remote from the exposed roof strata to impose reactive forces upon the roof strata as a distributed compressive stress while the tensile member converts to infintely variable resultant vertical force components which prestress the native roof strata in a manner to increase the friction between adjacent strata to impart shear resistance. The novel feature of the invention is that the prestressing forces are imparted uniformly into the strata without harmful stress gradients that contribute to shear fractures.

Usually, the problem in the personal safety for mine workers is that there is too little space to produce coal economically and at the same time to provide protection to mine workers. Mechanical roof supports that interfere with the productivity are not an acceptable solution to the problem.

Mine openings have been supported in the past by timbers, concrete, metallic structures and, more recently, by roof bolts. Experimental devices have been developed for supporting the entries of mine openings wherein these devices take the form of mobile roof supports that are hydraulically operated. Other suggested measures include the use of plastic adhesive to impregnate the roof strata, or using shotcrete or coating techniques for protecting roof strata from moisture and oxygen. However, these measures are only partially effective in supporting rock strata. In recent years, longwall mining techniques brought about the use of roof chocks and roof shields. These devices are self-advancing hydraulically to hold the roof in the immediate area of the longwall mining machine away from the machine as well as the operators therefor.

In recent years, roof bolting has become widely accepted. The roof bolts are effective to suspend the lower rock strata from upper competent strata. Similarly, other concepts utilizing the roof itself as a structural member are possible. In my prior U.S. Pat. Nos. 4,091,628 and 4,146,349, mine roof supports and rib supports are disclosed using an elastic member. The member takes the form of a curved plate that is prestressed by a flattening force against a surface of the mine opening. Various different forms of support are used for emplaced support of the plate. These include roof bolts inclined at an angle of 45° to the plane of the plate.

Part of the rationale for selecting the size and strength of a roof support system is based upon the experience of roof falls in actual coal mining. A study shows that the median roof fall was only one-foot thick, and 90% of major roof falls involve roof strata four-feet thick or less. A median roof fall can be prevented by a 150-pound vertical force on each square foot of roof strata; also, to prevent major roof fall, a 600-pound vertical force on each square foot of roof strata is needed.

When, in situ, stresses exist in the upper roof strata of a mine opening, reactive forces to these stresses and tensile stresses from an external member such as roof bolts create a clockwise force couple at the left side of the mine roof strata and a counterclockwise force couple at the right side of the mine roof strata. The resultant forces are usually undesirable and adverse to effecting support through a beam action. It is a common practice as disclosed, for example, in U.S. Pat. No. 3,427,811, to incline roof bolts at an angle of 45° for installation of truss supports. An analysis of this configuration of roof support indicates that force components are established at the point where the inclined bolt projects downwardly from the roof strata. These force components bend around the rock corner such that the stressed bolt imparts a concentrated compressive stress upon the immediate roof strata. This is undesirable because it tends to cause buckling of the lower roof stratum. When the anchoring roof bolt is fully grouted and resin-anchored as is the case with many such roof bolts, the effective locus of the anchor may be at the corner where the bolt extension bends around the lower stratum and/or around a spacer block near the corner. Except for the corner bearing on the bolt, the point anchoring at the upper end of the bolt produces a resultant force in the strata in a direction of 62-$\frac{1}{2}$° from the horizontal. In other words, when roof bolts penetrate the roof strata at an angle of 45° toward the side rib, the resulting force is oppositely directed at an angle of 62-$\frac{1}{2}$° from the horizontal. This upward-point loading is a suspension effect applicable to the local region not a beam effect induced in the native roof strata from rib-to-rib.

The present invention provides a method and apparatus to control the counterclockwise and clockwise force couples in the immediate roof strata so that these forces are imposed at anchoring sites on the general strata at a distance away from the immediate native roof strata whereby undesirable force components do not enter the local beam support function. The present invention is directed to a systemic beam support that includes utilization of native roof strata as a major component of the systemic beam. In contrast to this, the current practice of anchoring trusses with roof bolts inclined at a 45° angle does not produce a beam-type support but rather only a suspension-type support of localized regions of mine roof. The present invention is based on the discovery that by using roof bolts or other anchoring devices to impart the prestressing tensile force as a lower element of the beam from an anchor point at a considerable distance into the strata above the seam at some slight angle of between 0° and 30° from the horizontal, the tensile element is incorporated as part of a systemic beam support system. The most desirable angle is that which is provided by a true catenary curve at the point of attachment or at the point of entry into the anchoring hole. Avoiding a discrete angular change at this transition point avoids the concentration of stresses at this region. Due to force couples and the inaccessibility of the upper strata, there is no effective way for imparting a compressive stress into the upper layers of the strata at, for example, 3–6 feet above the roof. However, by anchoring the roof bolts or other members on the general strata, the reactive compressive stress to which these members are subjected is distributed to the general rock measures.

SUMMARY OF THE INVENTION

It is an object of the present invention to provide a systemic roof control of native roof strata in a mine opening by providing a uniform or specifically-distributed upward force to effect an adequate shear resistance within the native roof strata for the entire distance between the sides of the opening by creating friction between the strata.

It is a still further object of the present invention to provide a systemic roof control of native roof strata by installing a horizontal tension member immediately below and in contact with the lowest strata layer either directly or indirectly with the tensile member being prestressed.

More particularly, according to the present invention there is provided a method for systemic roof control of native roof strata in a mine opening including the steps of horizontally-arranging an elongated tensile member immediately below the lowest stratum layer of native roof strata, securing anchors within general strata horizontally remote to the native roof strata to impose reactive anchoring forces compressively upon the upper general strata at sites distally isolated from the native roof strata, coupling the tensile member to the anchor members under a prestressed elongation, and using the tensile member to resolve the prestressing forces into compressive forces applied uniformly in one directions normal to the roof strata for increasing friction between layers of native roof strata to impart vertical shear resistance without significant horizontal compression of the native roof strata.

The preferred manner by which the tensile member is anchored according to all embodiments of the present invention includes installing roof bolts over a natural support pillar to extend outwardly and usually downwardly therefrom into the mine opening at an angle of typically between about 0° and 30° to the horizontal, preferably the angle of the effective curve of the tensile member at the transition points. The increased friction between layers of native roof strata is created, according to one aspect of the present invention, by forming a catenary assembly through the use of a profiled spacer for compressive engagement between the tensile member and the lowest stratum layer of native roof strata.

Another means of approximating the same systemic effect in the roof strata takes the form of replacing the profiled spacer between the tensile member and the lowest stratum layer by a densely-spaced array of vertical roof bolts to bind the tensile member to the roof strata and thereby incorporate the tensile member as the lower member of a systemic beam system. In this aspect, the tensile member is anchored to nearly horizontal anchor bolts because no vertical component is derived from the anchoring.

A further means of achieving the systemic effect in the roof strata is replacing the profiled spacer and tensile member used to form a catenary assembly by using a flattened elastic member which prestresses the native roof strata identically to the catenary assembly.

According to this aspect of the present invention, the tensile member, in its free state, takes the form of a generally arch-shaped elastic member which is placed in contact with the lowest roof stratum layer such that the curved ends extend downwardly therefrom. The member is elastically flattened by directing a force upon each of the curved ends toward the roof strata to compressively stress the member against the roof strata. Roof bolts contact the ends of the stressed member, the angle at which the bolts extend for contact with the member is typically between about 0° and 30° to the horizontal.

The angle is determined by the angle of arc equivalent to the catenary profile of the tensile member at the point of attachment to the roof anchor. In this aspect of the invention, the elastic flattening of the member prestresses the lower part up to about 40% to 50% of the ultimate and prestresses the upper part in compression up to about 100% of the ultimate. The anchoring of the member using roof bolts imposes a tensile strain in the lower part of the member approaching ultimate while reducing the compressive prestressing in the upper part of the elastic member. There is then a direct relationship betweeen the angle of the anchor and the applied tension.

These features and advantages of the present invention as well as others will be more fully understood when the following description is read in light of the accompanying drawings, in which.

Figure 1:
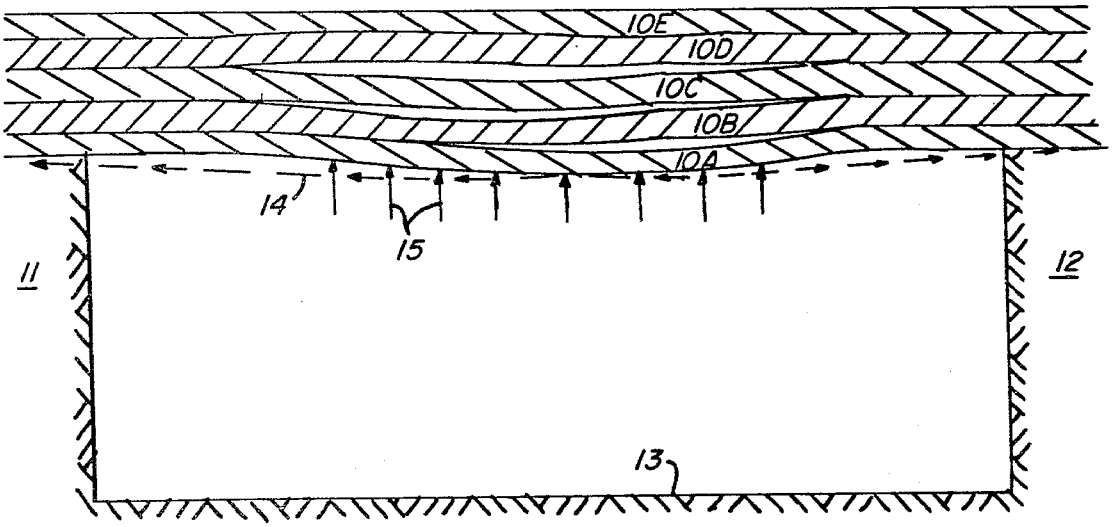
FIG. 1 is a schematic view illustrating the tensile and normal forces created for a systemic roof support according to the present invention.

The systemic mine roof control of the present invention utilizes natural roof strata as a major structural component to convert incompetent roof strata into an effective continuous beam which spans literally across a mine opening or diagonally across an intersection of mine openings. The method and apparatus provided by the present invention supply artificial requisite properties of all simple beams that most natural strata lack, namely, the internal shear resistance between separated stratum layers; tensile strength especially in the extreme lower stratum layer; and shear strength in a direction upwardly across the strata above the pillar or rib line. FIG. 1 illustrates the manner by which these properties are imparted to mine roof strata in which reference numerals 10A–10E identify native roof stratum layers with the lowest stratum layer being identified by reference numeral 10A. Pillars or ribs 11 and 12 support the roof strata. Reference numeral 13 identifies the mine floor. The illustration by FIG. 1 is intended to depict incompetent roof strata which typically occur by separation between stratum layers. There is a lack of internal shear resistance in the roof strata and a lack of tensile and shear strength which develop as a sagging of the stratum layers. As illustrated in FIG. 1, the void spaces typically develop between the lower stratum layer, e.g., layers 10A, 10B and 10C. Reference numeral 14 identifies the direction of a tensile force needed to create the systemic beam support for the mine roof. The tensile force must be established in a generally horizontal direction; however the preferred anchoring site for establishing the tensile forces extends along a line at an angle of about 0° to 30° from the horizontal from a deeply embedded site in the roof stratum overlying the support ribs 11 and 12. Reference numeral 15 identifies the direction of lines of force generally normal to the tensile force line 14 which are needed to impart shear resistance to the mine roof strata.

Figure 1A:
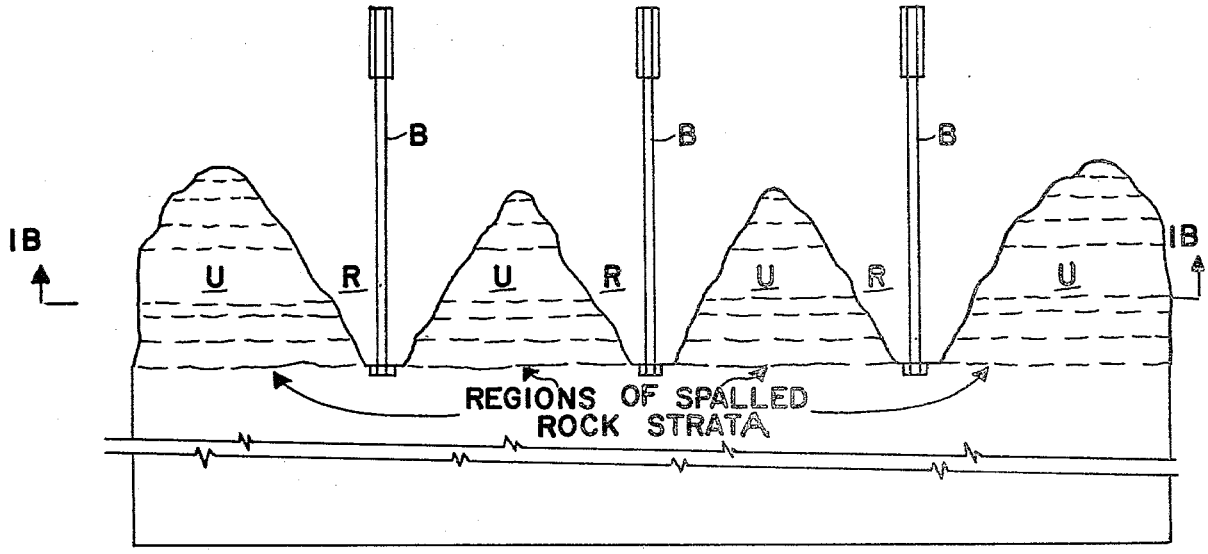
FIG. 1A is a schematic view illustrating the effectiveness of roof bolting.
Figure 1B:
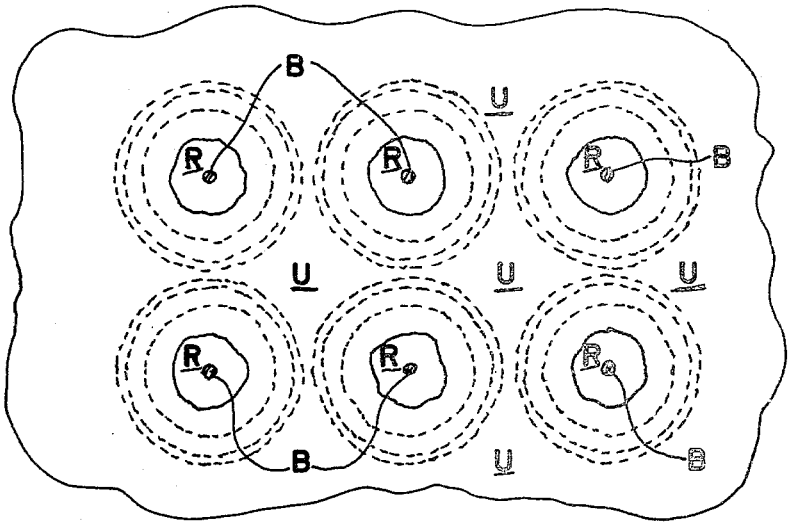
FIG. 1B is a sectional view taken along line IB—IB of FIG. 1A.

Other means for controlling the roof in the mines do not achieve a systemic effect when this is defined as imparting to the strata the necessary features lacking in most natural rock strata. Many roof support schemes are of the "passive" type which simply afford protection to men and equipment when the roof failure occurs. More current roof control measures attempt some systemic control but achieve only partial systemic effect. Moreover, these measures induce further damage to the roof strata which are themselves contributory causes of roof failure. FIGS. 1A and 1B, for example, show the effect of roof bolting in typical 4'×4' patterns. Friction binding is achieved in the strate only in conically-overlying regions R of bolts B. Unsupported areas or regions U of the strata between the bolts are not bound together, shear resistance is not increased there. The effectiveness of roof bolts in most mines where they are used is due to the suspension effect wherein the bolts directly support the strata in the region of the bolts. The shape of the region of the strata thusly effected by the suspension effect is an inverted conical frustum. At the interface between the bolt-bound region of the inverted cone and the unsuspended strata, a stress gradient occurs which is deleterious to the rock and causes shear failures at the cone interface. This phenomenon is frequently observed in bolted roof as spalling rock strata.

Figure 1C:
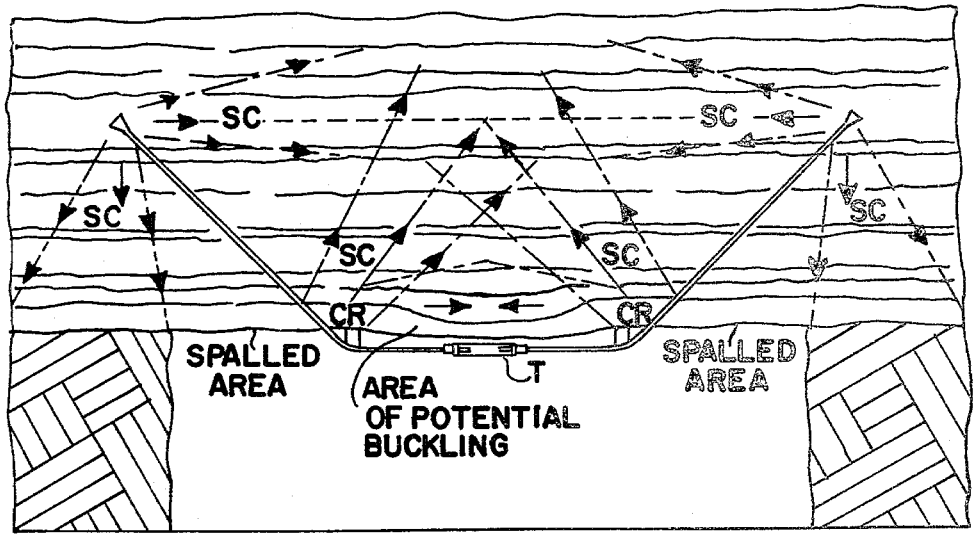
FIG. 1C is a schematic view of a roof truss support arrangement that does not embody the features of the present invention.

As shown schematically in FIG. 1C, roof trusses T anchored by the bolts angled typically at 45° to the horizontal also create deleterious effects in the roof strata. In addition to creating regions of high and low stress concentrations SC and corresponding stress gradients, trusses also establish a concentrated compression region CR in the lowest stratum layer between the opposing rock corners and spacers. As the horizontal tensile member of a truss is tightened by a turnbuckle T, the horizontal tension forces are reacted by the rock stratum at these corners in compression as much as by the bolt anchors. As shown in FIG. 1C, opposed horizontal stress components located in the incompetent lower stratum often cause the layer to buckle.

Figure 2:
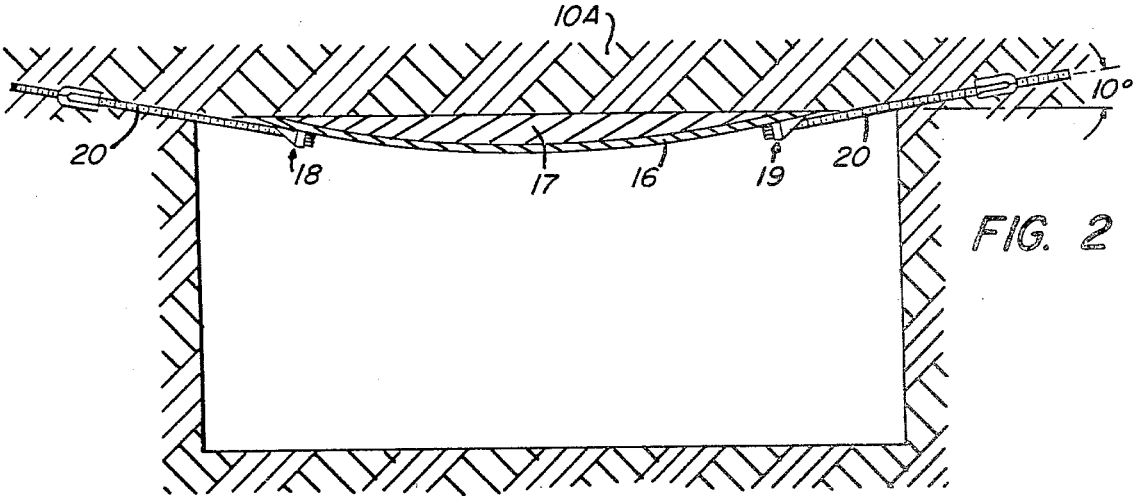
FIG. 2 illustrates a spacer-plate arrangement supported by bolt members according to the present invention.

The present invention, therefore, provides a method and apparatus for uniform or specifically distributed, greater in the center of the mine opening, lines of vertically-directed forces to effect an adequate shear resistance within the native roof strata by creating friction between the strata and the translation of reactive forces to a prestressting force through the upper strata, i.e., of the order of 3 to 10 feet, as a compressive stress. This translation of forces within the general strata including the upper stratum layers is achieved according to the present invention. Imposing forces within the upper strata develop useful reactive forces. To utilize these forces according to the embodiment of the invention shown in FIG. 2, a horizontal tensile member 16 is installed immediately below the lowest stratum layer 10A and a profiled spacer 17 or compressive layer is interpositioned to thereby form a generally catenary structure.

The tensile member typically takes the form of a flat plate having a rectangular shape with a slight longitudinal arched configuration to conform with the shaped spacer which typically has a catenary or parabolically-curved surface in contact with the tensile member. The tensile member is prestressed, if desired, in the longitudinal direction by suitable means such as a piston and cylinder assembly or a mechanical jack operatively arranged to extend between end members 18 and 19 provided on the ends of the tensile member. Prestressing of the tensile member produces a slight, but insignificant, elongation. It is, however, not necessary to prestress the tensile member prior to emplacement. It is important that during emplacement, the tensile member is stressed in the direction of its length. The stressing forces in the tensile member are transferred by members such as long roof bolts 20 to the general strata including upper strata above the ribs by anchoring the roof bolts at sites where the reactive forces to the prestressing tensile stresses are not detrimental to local systemic roof support. This is achieved by providing anchor points in the general strata at a distance away from the immediate native roof strata. It is preferred to employ three or four one-inch diameter roof bolts 20 at each end of the tensile member with resin anchoring, typically, an epoxy material so that the roof bolts extend from the general strata above the ribs. The roof bolts are installed at an angle of between 0° and 30° to the horizontal, preferably the angle of the effective curve of the tensile member at the transition point. When choosing the angle of inclination for the roof bolts, it is important that the angle is sufficient to impart a vertically-distributed thrust. The roof bolts which may have a length of between 6 to 10 feet, are joined to the respective end members 18 and 19 for transferral of the stressing force to the bolt members. If means were used for imparting prestressing force to the plate member 16, they are then removed. The maximum distance which the stressed plate is spaced by spacer 17 from the roof strata is within the range of ½ to 6 inches in the medium mine heights and up to 18 inches for higher mine seams. The vertical component to the stressing forces on the plate member is imposed via the spacer member 17 upon the layers of native roof strata, thereby increasing friction between these layers through the distributed force for imparting shear resistance.

Figure 5:
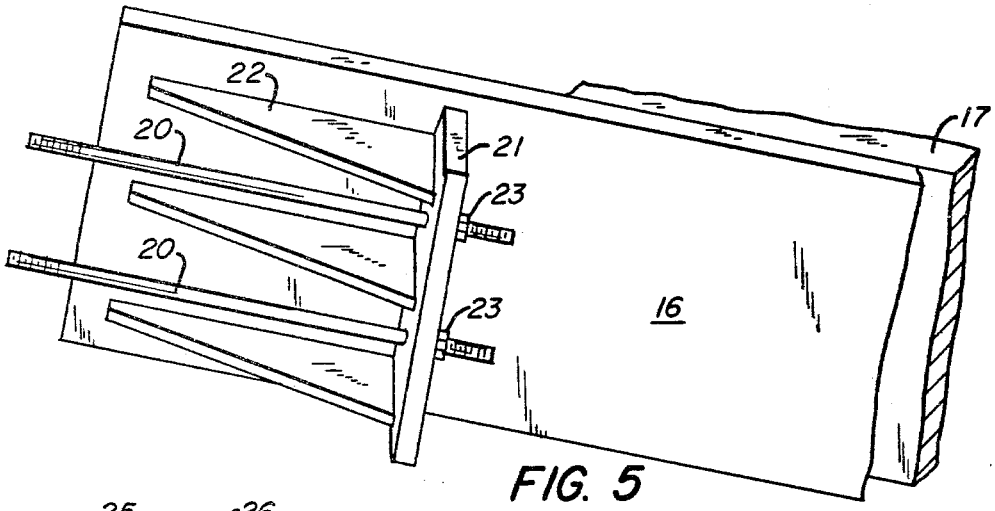
FIG. 5 is an enlarged isometric view of the spacer-plate arrangement shown in FIG. 2.
Figure 6:
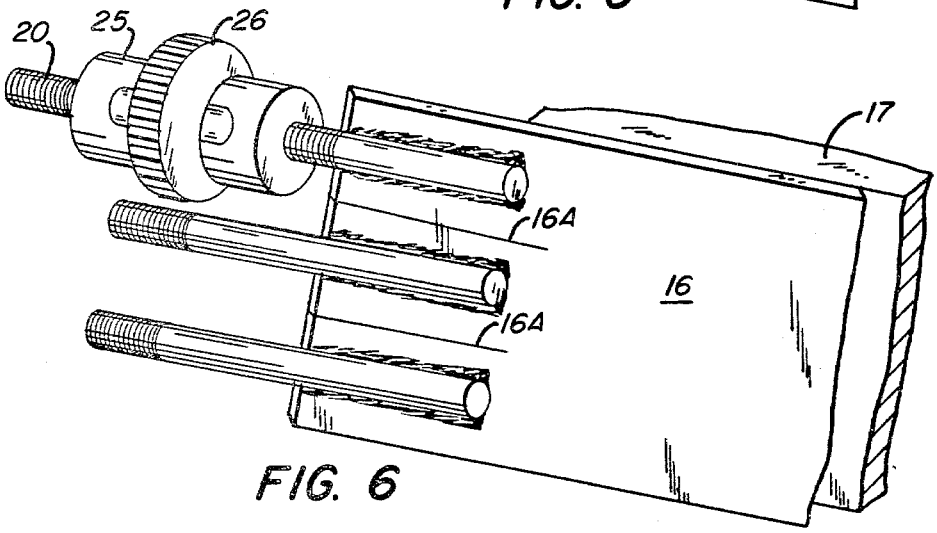
FIG. 6 is an enlarged isometric view of a further embodiment of parts for the aspect of the invention shown in FIG. 2.

FIGS. 5 and 6 illustrate two preferred forms of parts to anchor the tensile member under a stress elongation. In FIG. 5, the tensile member 16 is pressed against a shaped spacer 17 through forces resulting from anchoring the plate. The roof bolts 20 have threaded ends that pass through openings in a downwardly-projecting plate 21. Plate 21 is welded, or otherwise attached, to the tensile member support and gussets 22 are attached by welding to assure efficient transferral of the stressing forces to tensile member 16 by the development of torque upon nut members 23. It will be observed that the roof bolts extend through openings located in the space between gussets 22 and that the nut members are located at the opposite side surfaces of plate 21 where they are readily accessible.

In FIG. 6, the plate member 16 is formed with end segments formed by dividing lines 16A that extend parallel to the extended length of the tensile member. Welded or otherwise attached to each end segment is a threaded shaft 24 arranged so that a threaded portion overhangs the tensile member. If desired, the segments may be deformed so that they wrap around the length of the shaft members attached by welding. Additional welding may be used to enhance the attachment of the rod members to the tensile member. Received on the overhanging and threaded end of each rod member is an internally-threaded tube 25 which also engages by the internal threads thereof the threaded end portion of the roof bolts. The threaded tube is rotated by suitable means such as securing gear 26 to the external surface of the tubular member. Gear 26 is rotated by meshing engagement with the teeth of a rotary actuator, not shown. The tubular member may, if desired, be rotated by providing flattened surfaces to receive a spanner wrench. The threaded ends of a roof bolt 20 and rod member 24 are arranged such that rotation of the sleeve member draws the threaded portions toward one another, thus stressing the tensile member 16.

Figure 3:
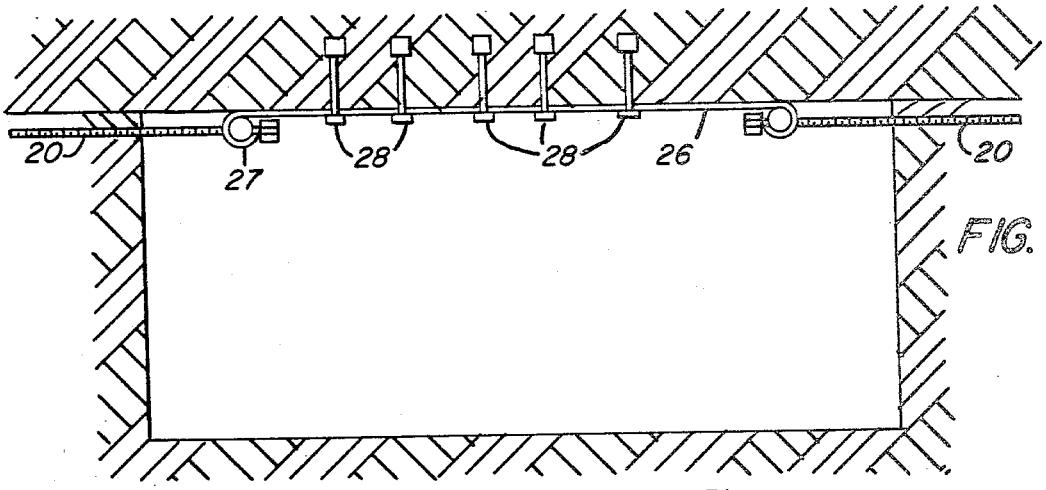
FIG. 3 is a view similar to FIG. 2 and illustrating a second arrangement of apparatus which is also useful to carry out the method of the present invention.

In FIG. 3, there is illustrated a further embodiment of the arrangement of parts for carrying out the systemic roof support concept of the present invention. A tensile skin 27 essentially comprised of a strip of high strength material, e.g., a $\frac{1}{8}$-inch thick metal strip, is arranged to extend across the mine opening immediately below the lowest layer of roof strata. The opposite ends of the strip are joined with attachment members 28 between which, if desired, tensioning means is arranged to impose a pretensioning force on the tensile skin producing a slight elongation thereof. Typically, the attachment members 28 each includes a length of pipe corresponding to the width of skin 27. The end portion of the skin is wrapped about the pipe and attached by fasteners or welding. The roof bolts 20 after emplacement as already described, are passed through drilled openings in the end members. Nuts are torqued on the threaded ends of the bolt to maintain or impose a stressing force on the tensile skin. If desired, the arrangement of parts described previously in regard to FIGS. 5 and 6 may be utilized to provide end members on skin 27.

The distribution of an upward force for imparting shear resistance to the native roof strata is carried out by binder members such as densely-spaced roof bolts 29 installed to impose a vertically-upward directed force upon the lower roof stratum layer. The roof bolts are arranged to distribute the upward force for increasing friction between the layers of roof strata and thereby imparting shear resistance thereto. Such roof bolts do not need to be exceptionally long to effect a beam action, typically, for example, between 2 to 4 feet in length. Such roof bolts may be anchored by mechanical members, resin or grouted by inorganic cement. In the distribution of roof bolts 29, preference is given to the center section of the systemic beam and as many bolts are utilized as is economically feasible. Instead of employing roof bolts, other types of binders may be used to provide shear resistance. Such binders include split sets or adhesive resin, interposed between the tensile skin and the lower layer of roof strata.

Since the vertical stress in the roof strata is achieved by the vertical roof bolts or other binding means, no vertical component is derived from the end anchoring bolts. These, then would be horizontal rather than at some angle to the horizontal.

Figure 4:
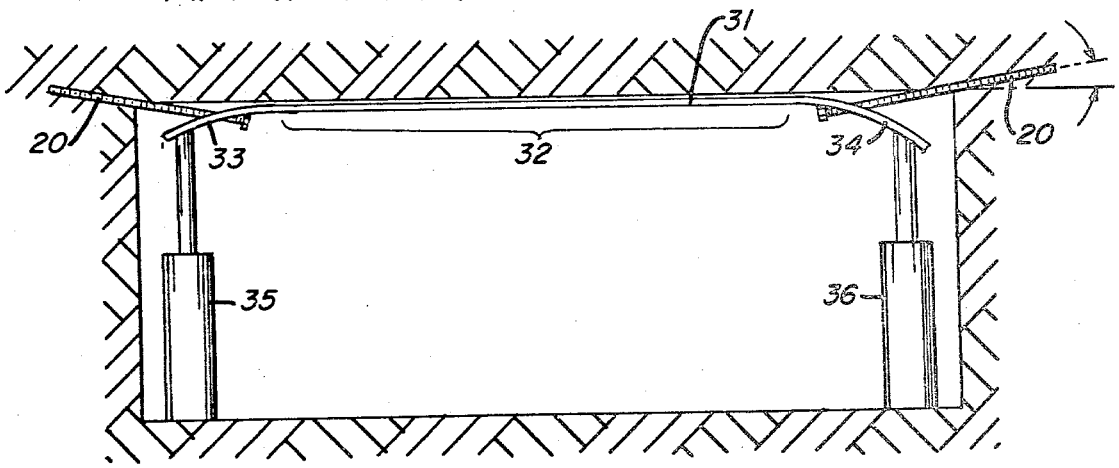
FIG. 4 is a view similar to FIGS. 2 and 3 and illustrating a further arrangement of apparatus to carry out the method of the present invention.

In FIG. 4, there is illustrated a still further arrangement of parts for providing a systemic roof control of native roof strata in a mine opening. An arch-shaped beam member 31, such as a plate, is arranged in regard to the arch-shaped configuration thereof, such that the central mid-portion 32 contacts the surface of the lower roof stratum while downwardly-curved ends 33 and 34 are spaced from the roof surface. Beam member 31 is made from a high tensile strength material such as hardened carbon steel, alloy steel, high quality aluminum alloy, glass reinforced plastic, ferrous and non-ferrous titanium alloy metal and ferrous and non-ferrous magnesium alloy. An important feature of the plate is that it has a precurved configuration and sufficient strength under compression to exert a stressing force exerted against the roof along at least the mid-portion thereof. Actuators 35 and 36 are arranged to extend between the downwardly-curved end portions 33 and 34, respectively, and the floor of the mine opening. Typical forms of actuators include hydraulic cylinder assemblies or mechanically-operated jack members. Such actuators are used to deliver a force against the downwardly-curved ends of the beam member toward the mine roof. The force is applied after the beam members are placed against the roof surface. The beam is then stressed through operation of the actuators by elastically displacing the curved ends toward the roof surface. A gap may actually exist between the curved end portions when displaced and the roof surface. After stressing of the beam member, the opposite ends thereof are attached to roof bolts 20 in the same manner as described hereinbefore, in regard to FIGS. 2 and 3. It being understood, of course, that stressing of the beam member 31 is carried out in a manner different from that described in regard to the tensile members of FIGS. 2 and 3. The roof bolts are attached to the beam member in a manner which modifies the stressing of the beam through the actuators. In this regard, as the elastic beam is prestressed, the lower portion of the beam member along its length is stressed under tension to approximately 40% of ultimate; while at the same time, the prestressing forces impart a strain in compression on the upper surface of the beam member which approaches 100% of ultimate. The prestressing strains that are additionally imparted by the roof bolts are considerably less than that which would destroy the arched effect of the elastic beam. The initial prestressing develops a differential prestress between the upper and lower fibers or surfaces of the beam. The beam performs both the function of providing an upward thrust to increase shear resistance to the native roof strata by increased friction between the layers thereof while at the same time, providing a tensile skin below the roof strata. The prestressing reactive forces are imposed on the upper strata as a compressive stress distinctively apart from the native roof strata of the mine opening. To increase the shear resistance between the elastic beam and the roof stratum, adhesives may be added to the upper surface of the beam and the roof surface before emplacement of the beam. In view of the foregoing, it is to be understood that the beam is initially prestressed such that the lower surface or fiber of the beam is stressed in tension to perhaps 40% to 50% of ultimate; while the upper fiber or surface of the beam is stressed in compression to nearly 100% of ultimate. Compressive stressing per se adds nothing to the systemic concept of a beam support for the strata of the present invention since it is not needed except for developing a couple or moment for upward thrust. The additional stretching action on the beam by the bolts 20 establishes a tensile stress in the lower surface or portion thereof approaching ultimate which is changed to a compressive stress in the upper member of the elastic beam to something considerably less than ultimate. The result of the stressed emplaced beam is the development of an upward force to hold the stratum layers in frictional contact for shear resistance and to provide a skin below the roof strata in high tension.

In the embodiments of the present invention described hereinbefore, the rib shear strengthening may also be achieved. In each of the described embodiments of the invention and, in particular, the normal emplacement of elastic beams when the ends of the beams are supported by posts, there is a tendency to reduce the stress gradients in the strata above the pillar line and also the inclined roof bolts extending well into the region over the pillars provide reinforcement against a rib shear. This is because the angle of inclination of the roof bolts to implement the systemic roof control is at an angle of less than 30° and preferably less than 15° whereby they are, in effect, nearly at right angles to the shear plane when this type of failure is experienced in mining.

In view of the foregoing, it will be understood by those skilled in the art that a tensile member of any of the various forms described may be inserted at the intersection of mine openings as well as along a mine opening. Moreover, the tensile members are used for systemic roof control and serve an additional important function, namely, sealing the strata from weathering, thus preventing deterioration. In instances where 100% coverage of the roof strata is not provided by tensile members, it might be desirable to use other well-known forms of surface coverage between the tensile members.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A method for systemic roof control of native roof strata in a mine opening including the steps of horizontally arranging an elongated tensile member immediately below the lowest stratum layer of native roof strata which is, securing anchors within general strata horizontally remote to the native roof strata to impose reactive anchoring forces compressively upon the upper general strata at sites distally isolated from the native roof strata, coupling the tensile member to the anchor members under a prestressed elongation, and using the tensile member to resolve the prestressing forces into compressive forces applied uniformly in only directions normal to the roof strata for increasing friction between layers of native roof strata to impart vertical shear resistance without significant horizontal compression of the native roof strata.

2. The method according to claim 1 wherein said step of using the tensile member includes arranging a profiled spacer for compressive engagement between said tensile member and the lowest stratum layer of the native roof strata.

3. The method according to claim 1 wherein said step of securing anchors includes installing at least one roof bolt over a pillar of native strata to extend outwardly into the mine opening at an angle which substantially corresponds to a catenary profile of the tensile member at the point of attachment to the anchor.

4. The method according to claim 1 wherein said step of securing anchors includes installing at least one roof bolt over a pillar of native strata to extend outwardly into the mine opening at an angle substantially corresponding to the effective curve of the tensile member at the transition point.

5. The method according to claim 1 wherein said step of coupling the tensile member includes elongating a plate member under tension by an actuating member coupled thereto.

6. The method according to claim 1 wherein said step of horizontally arranging an elongated tensile member includes contacting the lowest roof stratum layer with a tensile skin strip, and wherein said step of using the tensile member includes installing shear resisting members to bind said tensile skin strip to the lowest stratum layer for incorporating said tensile skin strip as a lower member of a systemic beam.

7. The method according to claim 6 wherein said step of anchoring the tensile member further includes engaging said tensile skin strip at each end with roof bolts extending in a generally horizontal direction into a pillar of native strata.

8. The method according to claim 1 wherein said step of horizontally arranging an elongated tensile member includes contacting the lowest roof stratum layer with a tensile skin strip, and wherein said step of using the tensile member includes binding said tensile skin with roof bolts passed through such layer into the roof strata to incorporate said tensile skin as the lower member of a systemic beam.

9. The method according to claim 1 wherein said step of horizontally arranging an elongated tensile member includes arranging a generally arch-shaped elastic member against the lowest roof stratum layer with the curved ends extending downwardly therefrom and elastically flattening the elastic member by directing a force upon each curved end toward the roof stratum to compressively stress the elastic member against the roof stratum, and wherein said step of coupling the tensile member includes contacting the ends of the elastic member with roof bolts extending outwardly from a pillar of native strata at an angle which substantially corresponds to a catenary profile of the flattened elastic member at the point of attachment to the anchor.

10. The method according to claim 9 wherein said elastically flattening the elastic member includes prestressing the lower part of the elastic member up to about 40% to 50% of ultimate and prestressing in compression the upper part of the elastic member up to about 100% of ultimate.

11. The method according to claim 10 wherein said step of coupling includes using said roof bolts to establish tensile stress in the lower part of the elastic member approaching ultimate while reducing the prestressing in compression in the upper part of the elastic member.

12. The method according to claim 1 wherein said step of horizontally arranging includes using adhesive to adhere said tensile member to the lowest stratum layer.

13. An apparatus for systemic roof control of native roof strata in a mine opening including the combination of an elongated tensile member arranged immediately and generally below the lowest stratum layer of native roof strata, and anchor means installed in the general strata which is horizontally remote to the roof strata at an angle substantially corresponding to the effective curve of the tensile member at points of attachment to said elongated tensile member, said anchor means being coupled to said tensile member at said point of attachment to maintain the tensile member under an elongation prestressing to resolve reactive forces and distribute essentially only vertical compression forces to the lower roof stratum layer for increasing friction between the layers of native roof strata without significant horizontal compression thereof.

14. The apparatus according to claim 13 further including a profiled spacer for compressive engagement between said tensile member and the lowest stratum layer of native roof strata.

15. The apparatus according to claim 13 wherein said tensile member includes an elongated plate.

16. The apparatus according to claim 13 further including roof bolts extending vertically into the native roof strata while coupled to said tensile member.

17. The apparatus according to claim 13 wherein said tensile member includes a generally arch-shaped elastic member arranged against the lowest roof stratum layer with curved ends extending downwardly therefrom, said apparatus further including actuators to direct a force upon each of said curved ends toward the roof stratum to compressively stress the elastic member against the roof stratum, and wherein said anchor means includes roof bolt members coupled to the ends of the tensile member while extending from a pillar of native strata outwardly therefrom at an angle of between about 0° and 30° to the horizontal.

* * * * *